United States Patent [19]

Hopmann et al.

[11] Patent Number: 4,917,191

[45] Date of Patent: Apr. 17, 1990

[54] METHOD AND APPARATUS FOR SELECTIVELY SHIFTING A TOOL MEMBER

[75] Inventors: Mark E. Hopmann, Broken Arrow; Douglas J. Murray; Scott C. Strattan, both of Tulsa, all of Okla.

[73] Assignee: Baker Hughes Incorporated, Houston, Tex.

[21] Appl. No.: 308,874

[22] Filed: Feb. 9, 1989

[51] Int. Cl.[4] ..... E21B 34/10; E21B 34/12

[52] U.S. Cl. ..... 166/381; 166/386; 166/334

[58] Field of Search ..... 166/381, 383, 386, 319, 166/332, 334, 384

[56] References Cited

U.S. PATENT DOCUMENTS

| | | | |
|---|---|---|---|
| 3,401,749 | 9/1968 | Daniel | 166/384 |
| 4,567,082 | 4/1987 | Ringgenberg | 166/386 |
| 4,724,908 | 2/1988 | Pringle | 166/332 |
| 4,823,877 | 4/1989 | McDaniel et al. | 166/332 |

FOREIGN PATENT DOCUMENTS

| | | | |
|---|---|---|---|
| 0750044 | 7/1980 | U.S.S.R. | 166/334 |

*Primary Examiner*—Jerome W. Massie
*Assistant Examiner*—Terry Lee Melius
*Attorney, Agent, or Firm*—Hubbard, Thurman, Turner & Tucker

[57] ABSTRACT

A method and apparatus are provided for selectively shifting a tool member in a subterranean well, such as a sliding sleeve of a ported element, which may be carried on a continuous length of remedial tubing, or other conduit into the well and insertable through a second conduit, such as production tubing. The apparatus comprises a cylindrical housing with a fluid passageway therethrough. Means are carried by the housing for selectively indicating proximity of the apparatus relative to the auxiliary tool, or ported member of a sliding sleeve. Actuating means are positioned by longitudinal manipulation of the first conduit, or remedial tubing, and movable into engaging position with a ported member, upon a first movement of the first conduit in a second direction to resist movement of the apparatus in the second direction. Normally retracted, selectively expandable shifting means are carried by the housing and movable to an expanded position by further movement of the first conduit in the second direction to move the shifting means into expanded position to interengage the movable means of the auxiliary tool, or ported member. Hydraulic means, including a piston, are activatable to drive the movable means of the auxiliary tool, thereafter, in one of opening and closing directions, or into actuating position, when the shifting means are in the expanded position. Releasing means are provided for moving the actuating means into disengaging position and for moving the shifting means thereafter into the normally retracted position, for retrieval of the tool to the top of the well.

17 Claims, 5 Drawing Sheets

METHOD AND APPARATUS FOR SELECTIVELY SHIFTING A TOOL MEMBER

BACKGROUND OF THE INVENTION

1. Field of the Invention:

The invention generally relates to a method and apparatus for selectively shifting a tool member in a subterranean well.

2. Description of the Prior Art:

In the past, those skilled in the art relating to remedial operations associated with the drilling, production and completion of subterranean oil and gas wells have relied on conventional "snubbing" or hydraulic workover units which utilize threaded or coupled remedial tubing normally inserted through production tubing for use in operations, such as perforating, acidizing and fracturing, corrosion control, pressure testing of tubular goods and vessels, cementing, clean out operations, sand bridge removal, storm valve recovery, insertion of kill strings, wireline tool fishing, and the like.

Continuous coiled remedial tubing and injectors for use therewith have contributed substantially to conventional remedial tubing operations. For example, coil tubing, being continuous, can be inserted into the well faster than threaded and coupled tubing which is furnished in relatively short sections that must be screwed together. In addition, it is easier, when required, to pass continuous tubing through stuffing boxes and blowout preventers because its external diameter is consistently the same size and not interrupted periodically by couplings. The coiled remedial tubing normally is made of steel and is commercially available in sizes from 0.75 inch o.d. through 1.315 inch o.d., but may have a smaller or larger diameter. Typical of such remedial coil tubing and injectors is that generally described in U.S. Pat. No. 3,182,877. The apparatus is commercially referred to as the "Bowen Continuous Spring Tubing Injector Unit" and basically comprises a hydraulically powered injector unit which feeds a continuous remedial tubing string from a coiled or "spooled" workstring contained on a powered and generally portable reel unit into the wellhead by means of two opposed, endless, rotating traction members. Such a reel unit is generally described in U.S. Pat. No. 3,614,019. The upper end of the string which remains on the reel is conventionally connected to the hollow shaft of the reel which permits a liquid or a gas to be pumped through the coiled remedial tubing string by means of a swivel connection. The injector and reel are normally mounted on a single transportable skid, a trailer, or, alternatively, may be componently arranged on skids to facilitate convenient offshore use.

To inject remedial coiled tubing, the injector is arranged on or above the wellhead. The reel unit, containing up to approximately 15,000 feet of continuous coiled metal remedial tubing, is located preferably about 15 to 20 feet from the wellhead. The remedial coiled tubing is brought from the reel in a smooth arc loop through the injector unit and into the well through pressure retention and control equipment.

For many years the desirability of utilizing a subterranean wellbore having a non-vertical or horizontal portion traversing a production formation has been known and appreciated in the prior art. Laterally directed bores are drilled radially, usually horizontally from the primary vertical wellbore, in order to increase contact with the production formation. Most production formations have a substantial horizontal portions and, when conventional vertical wellbores are employed to tap such production formations, a large number of vertical bores must be employed. With the drilling of a wellbore having a non-vertical or horizontal portion traversing the production formation, a much greater area of the production formation may be traversed by the wellbore and the total field of drilling costs may be substantially decreased. Additionally, after a particular horizontal wellbore has produced all of the economically available hydrocarbons, the same vertical wellbore may be redrilled to establish another horizontal portion extending in another direction and thus prolong the utility of the vertical portion of the well and increase the productivity of the well to include the total production formation.

By use of and reference to the phrase "wellbore" herein, it is intended to include both cased and uncased wells. When uncased wells are completed, the bore hole wall defines the maximum hole diameter at a given location. When cased wells are completed, the "wall" of the well will be the internal diameter of the casing conduit.

By use of the phrase "deviated well" and "deviated wellbore", it is meant to refer to wells and wellbores which comprise a vertical entry section communicating through a relatively short radius curvature portion with a non-vertical or horizontal portion communicating with the production formation. In most instances, the production formation extends for a substantial horizontal extent and the generally linear wellbore portion traverses a substantial horizontal extent of the production formation, at least up to a distance of 1000 to 2000 feet, or more. The radius portion of the wellbore has a curvature of at least 10° per 100 feet of length, and preferably a curvature lying in the range of 10° to 30° per 100 feet of length.

In such deviated wellbores, particularly those having the longer lengths, it is difficult, if not impossible, to activate completion equipment, such as shifting tools for opening and closing sleeves, activating wash tools, and the like, by means of conventional electric or piano wireline means, which are disposed through the production tubing which, in turn, has been implaced within the well section through casing (assuming that the well is encased), or, alternatively, through open hole (if the well is not so encased).

As the well section becomes more deviated, the weight suspended from the wireline will become insufficient to actuate the tool, or, at least, to properly position it at the desired location within the deviated portion of the well. Such tools can thus be expected to become improperly lodged or unpositionable within such well. Accordingly, remedial continuous coiled tubing can be utilized to perform operations in such wells heretofore practiced by application of wireline actuated devices.

During certain completion operations in a subterranean well, whether or not continuous coiled tubing is used during the completion procedure, it may become necessary to manipulate valves, sliding sleeves, releasing mechanisms, and other known well tools which are carried into the well either on production tubing, or casing. In many instances, such devices are provided in series in the well, and it is desirable to manipulate such devices on a selective basis. For example, if such devices are provided in a series of, say, six such devices, spaced 500 feet apart within the well, it may be desirable to actuate only the third such device, or, alternatively, actuate such devices serially. It therefore becomes quite desirable to provide means for actuating such devices having means thereon for indicating at the top of the well proximity of the apparatus relative to such device.

Additionally, such actuating devices can be expected to encounter considerable debris within the well which may cause interference with mechanical activation to manipulate the component of the auxiliary tool. Accordingly, the present invention combines mechanical manipulation of the apparatus in concert with hydraulic activation to thereby reduce operational interference caused by entrapment of particulate contaminants within various sensitive operational areas of the device and to also assure that mechanical manipulation of the apparatus does not, itself, cause inadvertent activation of the apparatus to prematurely manipulate the tool to actuate the auxiliary tool component when the apparatus is in fully engaged position relative thereto.

During acidizing, fracturing, or other completion operations wherein it is desirable to circulate a treating fluid for contact with the production zone, or other areas within the well, it has been known to provide a length of such production tubing with a ported member which has a series of radially extending ports provided within the housing which are selectively closed to prevent fluid flow between the interior and the exterior by means of what is commonly referred to as a "sliding sleeve", which is a member which is implaced within the interior of the device in proximity to the ports, and which is shifted by means of an auxiliary device between open and closed positions. At such time as it is desirable to inject the treating or other fluid into the annulus between the production tubing and the casing (or the open well, in the case of uncased wells), the sleeve is shifted to open the ports for fluid communication between the interior of the production tubing the exterior, or annular area, as defined.

Sometimes, such sliding sleeve is manipulated by a device which is carried into the well on wireline, such as electric or piano wire. However, in instances in which such sliding sleeve is positioned within a substantially horizontal section of a subterranean well during the horizontal completion of the well, it will become difficult, if not impossible, to manipulate the sleeve by such means, because the shifting means will either become stuck in the well prior to coming into proximity with the sleeve, or, if properly located, cannot be activated where the shifting device requires application of set down weight to shift the sleeve in a direction to move it to an opening or closing position. The present invention is directed to overcoming such deficiencies.

SUMMARY OF THE INVENTION

The present invention provides a method and apparatus for selectively shifting a tool member, such as a sleeve of a ported element which is carryable on either production tubing or casing within a subterranean well. The apparatus preferably is carried on a first conduit, which may be a continuous length of remedial coiled tubing concentrically insertable through a second conduit, such as production tubing which has been positioned previously within the well. The second conduit, or the production tubing, carries thereon at least one of such auxiliary tools, or "ported sliding sleeves", for selective transmission of fluids between the exterior and interior of the production tubing, or second conduit, each of the ported members receiving means movable in each of opening and closing directions for opening and closing the respective ported member, or auxiliary tool.

The apparatus comprises a cylindrical tubular housing having a fluid passageway therethrough which is communicable with the interior of the remedial tubing for transmission of fluid from within the remedial tubing through the apparatus and which is positionable in the well in proximity to one of the ported members, or auxiliary tools.

Means are carried by the housing for selectively indicating proximity of the apparatus relative to the ported member when the tubing, or first conduit, is moved in a first direction. Actuating means are activatable by longitudinal manipulation of the remedial tubing and are movable into engaging position with the ported member upon a first movement of the remedial tubing in a second direction, thereby resisting movement of the apparatus in the second direction.

Normally retracted, selectively expandable, shifting means are carried by the housing and are movable into an expanded position by movement of the remedial tubing in the second direction to move the shifting means into expanded position to interengage the movable means of the ported member. Hydraulic means are activatable to drive the movable means of the ported member in one of opening and closing directions when the shifting means are in the expanded position. Releasing means are provided for moving the actuating means into disengaging position and for moving the shifting means into normally retracted position. Thereafter, the tool may be retrieved to the top of the well.

DESCRIPTION OF THE PREFERRED EMBODIMENTS

Figure 1:
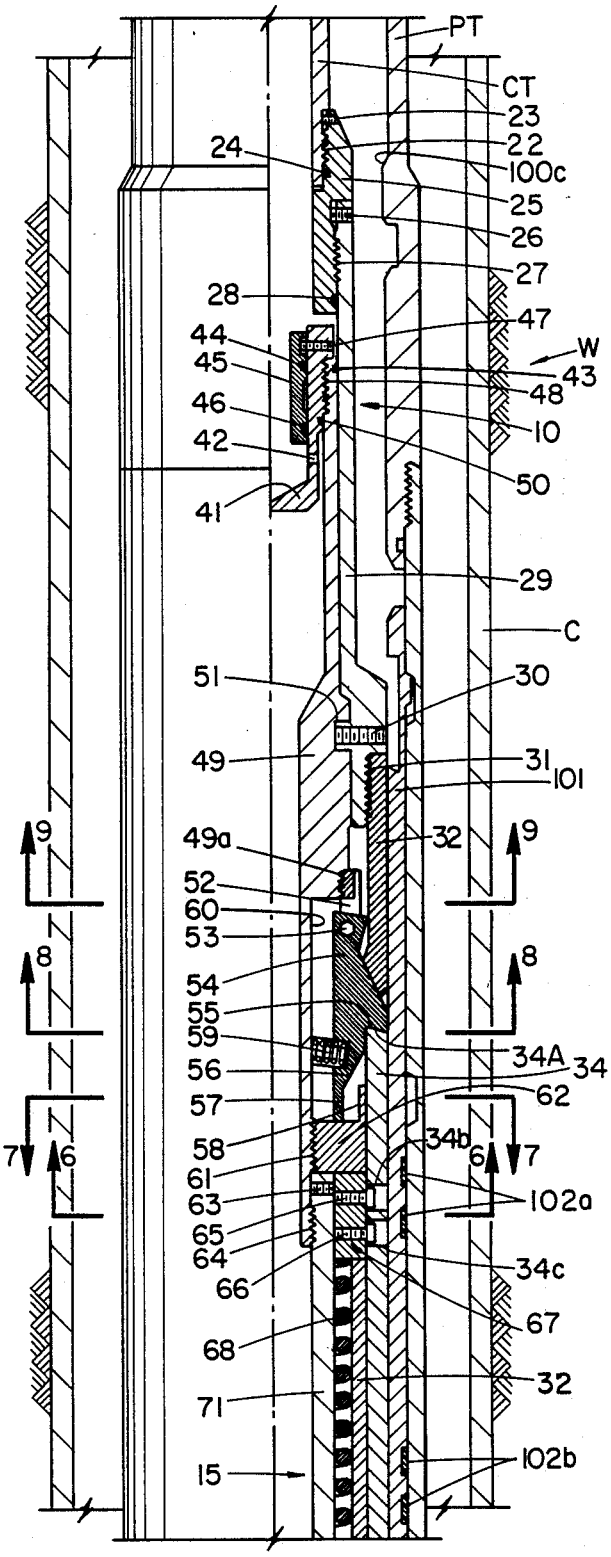
FIGS. 1 and 1A together are a longitudinal sectional illustration of the apparatus of the present invention in position interiorly of an auxiliary tool as the apparatus is run into the well and the selective indicating means being in position after detection of proximity location of the apparatus relative to the auxiliary tool.
Figure 1A:
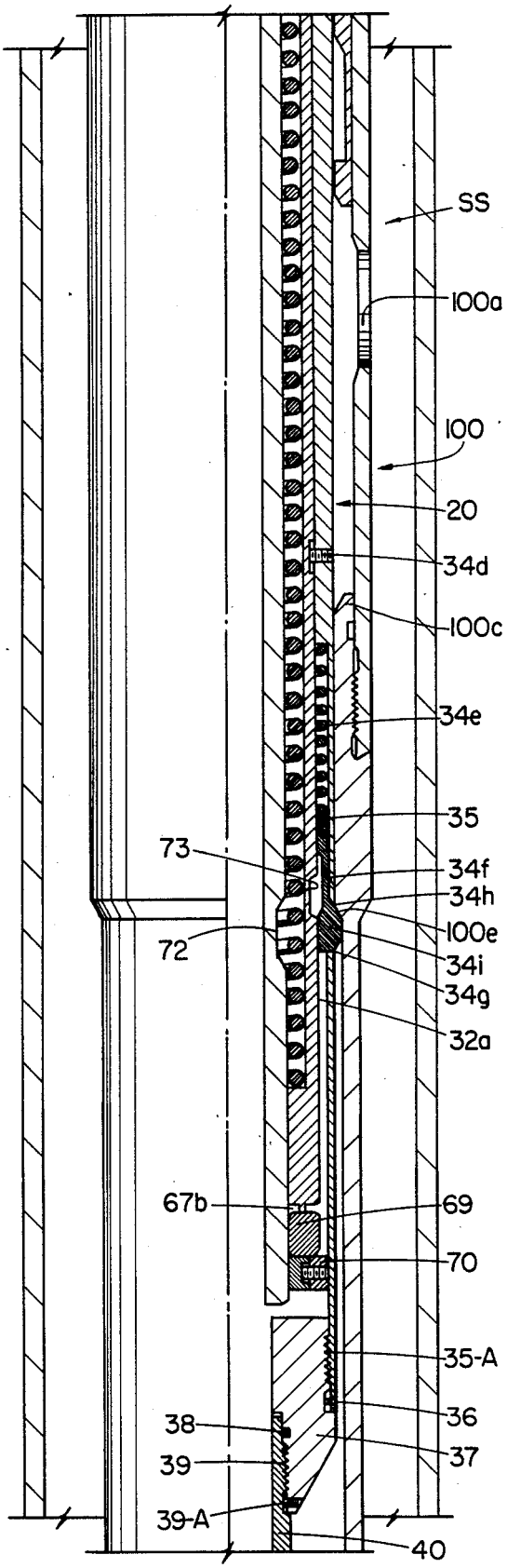

With first reference to FIGS. 1 and 1A, there is shown the apparatus 10 carried into the well on coiled tubing CT which, in turn, is concentrically disposed within production tubing PT previously run within the well W subsequent to cementing into place a string of casing C. The production tubing PT has extending thereon an auxiliary tool, such as a sliding sleeve SS with an outer housing 100 and a longitudinally manipulatable cylindrical sleeve member 101 disposed therein. The sleeve has upper and lower seal assemblies 102*a* and 102*b*, respectively which, when the sleeve 101 is shifted in one direction, will bridge a port 100*a* bored within the housing 100, and which, when the sleeve 101 is moved longitudinally in another direction to a second position, will permit fluid communication between the exterior of the housing 100 and the interior of the sliding sleeve tool SS.

The apparatus 10 basically is comprised of an outer housing assembly 20 and an inner mandrel system 15 implaced interiorly therein. The outer housing 20 has at its upper end a cylindrically shaped connector 25 which secures the apparatus 10 to the lowermost end of the coiled tubing CT. Threads 22 and a set screw 23 are provided for securement of the connector 25 to the coiled tubing CT, with O-ring 24 being in position between the connecting member 25 and the coiled tubing CT to prevent fluid communication therebetween.

A central housing member 29 extends circumferentially around the lowermost portion of the connector 25 and is secured thereto by means of threads 27 and set screw 26. An O-ring seal element 28 is housed within the lowermost end of the connector 25 to prevent fluid communication between connector 25 and the upper end of the central housing member 29.

The central housing member 29 receives a shear pin element 30 for selective securement between the member 29 and an upper mandrel member 49 of the mandrel system 15 therein. Threads 31 secure a spring housing member 32 extending exteriorly and below the central housing member 29, with the housing member 32 having a plurality of circumferentially extending windows 33, or slots, to permit housing and outward extension of the shifting dogs 54 therethrough, as described below.

Also forming a part of the outer housing 20 and positioned below the shifting dogs 54 is a cylindrical release mandrel 34 having a beveled shifting profile 34*a* at its uppermost end, the shifting profile 34*a* having its uppermost point at the internal diameter of the release mandrel 34 and conically extending downwardly to the external diameter of the release mandrel 34. A plurality of bores, 34*b*, 34*c* are provided in the release mandrel 34 for receipt of first and second shifting bolts 65, 66 which are screwed into a spring retainer 67 which, in turn, is carried at the uppermost end of a spring housing 32.

A shear screw assembly 34-*d* is carried within a bore on the release mandrel 34 for receipt within a companion groove in the spring housing 32 to initially secure the spring housing 32 in initial run-in position, as shown in FIG. 1, relative to the release mandrel 34.

The release mandrel 34 also houses a lower spring member 34-*e* which biases downwardly a series of circumferentially extending collet-like keys 34-*i* which are held in place within the release mandrel 34 and exteriorly around the spring housing 32 by means of a key retainer 35.

The keys 34*i* are normally retained inwardly of the release mandrel 34 and the outer housing 20 but have an upwardly beveled shoulder 34-*h* slightly extending through a window 34-*f* through the release mandrel 34.

The lower spring 34*e* drives the keys 34-*i* downwardly for initial run-in and normal positioning of the apparatus 10 into the well W and upon a no-go shoulder 34-*g* on the release mandrel 34 and defining the lower face of the window 34-*f*. The keys 34-*i* are held in such position by interengagement of the keys 34-*i* along the smooth outer surface 32*a* of the spring housing 32.

Threads 35-*a* are provided at the lowermost end of the release mandrel 34, together with a set screw 36, for securement of a bottom housing member 37 thereto, which, in turn, is secured to a connector 40 therebelow by means of threads 39 and set screw 39-*a*. An O-ring 38 is provided between the housing 37 and the connector 40 to prevent fluid communication between such members 37, 40. A wash tool (not shown), or other device may be secured to the apparatus 10 either below the connector 40, or by means of the connector 40.

Figure 3:
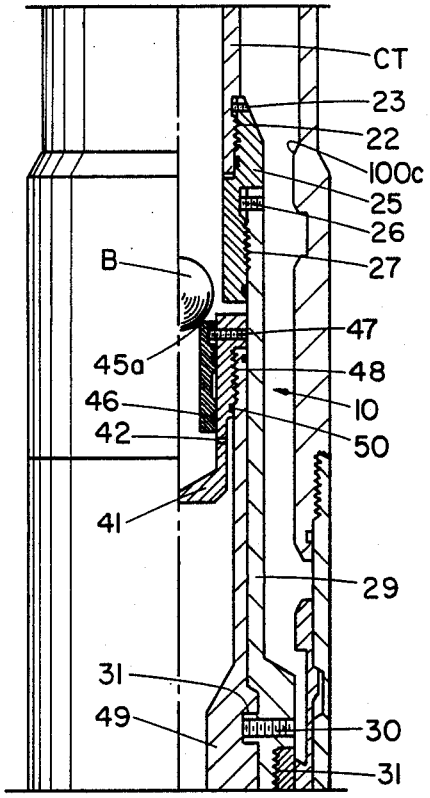
FIG. 3 is an enlarged partial view similar to those of FIGS. 1 and 2 showing activation of the hydraulic means to manipulate the auxiliary tool.
Figure 5:
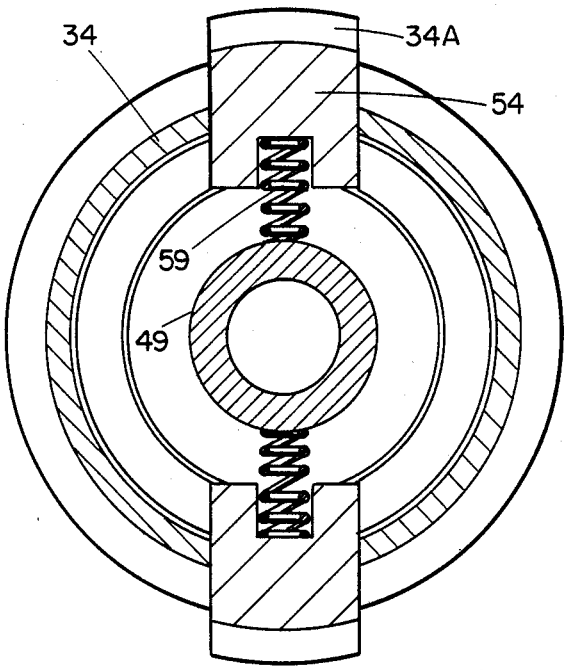
FIG. 5 is a cross-sectional view taken along lines 5—5 of FIG. 2.
Figure 6:
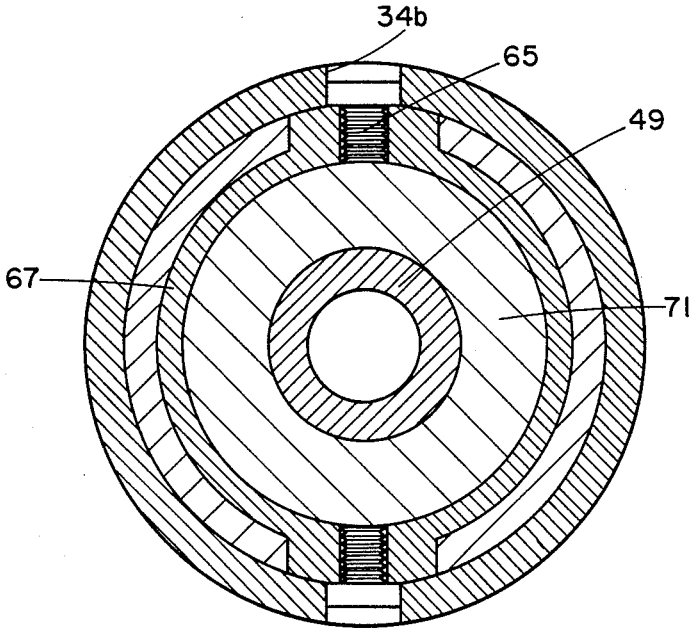
FIG. 6 is a cross-sectional view taken along lines 6—6 of FIG. 1.

The inner mandrel system 15 is housed within the outer housing 20 and is defined at its uppermost end by a hydraulic means, which includes, for example, a piston sleeve 45 shearably secured by means of a shear pin 47 to a cylindrical member 41 having ports 42 extending therethrough. As shown in FIG. 1 and FIG. 3 the ports 42 are open to permit fluid communication between, for example, the coiled tubing CT and the interior of the apparatus 10 for circulation of fluid there through for treatment or other purposes, well known to those skilled in the art.

The ports 42 may be selectively closed during actuation of the apparatus 10 to shift the sleeve 101 in one direction by application of hydraulic pressure, when a ball B is positioned, as shown in FIG. 3, upon a ball seat 45*a* provided at the uppermost end of the piston 45. O-ring seal elements 44 and 46 are carried around the exterior of the piston 45 and, when the piston 45 is hydraulically shifted to its lowermost position within the cylinder 41, such seals 44, 46 bridge the port 42 to prevent fluid communication between the interior of the solid cylinder 41 and the portions of the appartus 10 interiorly thereof and therebelow.

The cylinder 41 is secured at threads 48 to an upper mandrel member 49 extending lowerly therearound. An O-ring element 50 at the uppermost end of the upper mandrel member 49 prevents fluid communication between the member 49 and the central housing member 29 carried exteriorly therearound.

A bore 51 is provided in the upper mandrel member 49 for receipt of the innermost portion of the shear pin 30.

The upper mandrel member 49 has an inwardly profiled spring and shifting dog profile 60 which receives normally contracted, selectively expandable circumferentially extending shifting dogs 54 therein. The dogs 54 are secured by means of a pivot screw 53 to a shifting dog base 52, which, in turn, is secured at threads 49*a* to the upper mandrel member 49.

The shifting dogs 54 are urged outwardly of the spring profile 60 by means of a compressed biased spring member 59, but are retained in the retracted position (FIG. 1) by the interengagement of the release mandrel 34 at the shifting profile 34*a* thereon and a mating profile 55 on the shifting dogs 54.

Each of the dogs has a conically tapered outer surface 56, with such taper extending downwardly, and the taper 56 terminating in a longitudinal tongue 57 which, when the dogs 54 are urged outwardly by means of the spring 59 when the release mandrel 34 is in disengaged positioned relative to the dogs 54, terminates radial outward movement of the dogs 54 upon contact with a companion upwardly facing resistor surface 58 carried on a retainer member 62 threadably secured at 61 to the upper mandrel member 49. A set screw 63 and threads 64 secure the lowermost end of the upper mandrel member 49 to a cylindrical longitudinally extending spring mandrel 71 housing a main spring member 68 therein.

The main spring 68 is housed between the spring mandrel 71 and a cylindrical spring housing 32. The spring housing 32 receives the shear screw 34*d* therein which extends within a bore of the release mandrel 34 to retain the release mandrel 34 and the spring housing 32 in initial position as shown in FIG. 1A.

The spring housing 32 also has an inwardly profiled receiving groove 73 which receives, temporarily, the keys 34*i* as the apparatus 10 is moved in a direction within the well, i.e., downwardly, past auxiliary tools or sliding sleeve assemblies SS which are not desired, at such time, to be manipulated.

As the apparatus moves downwardly past such sliding sleeves, the keys 34*i* will contact an indicating profile 100*c* extending, slightly, outwardly of the other internal diameters of the sliding sleeves SS. Continued movement of the coiled tubing will cause the keys 34*i* to move upwardly within the window 34*f*, compressing the lower spring member 34*e*, and moving the keys 34*i* into the grooves 73. After passing lowerly of the locator shoulder 100*c* in a sliding sleeve SS, the keys 34*i* will be urged outwardly out of the groove 73 by the force defined in the biased lower spring member 34*e* to the position shown in FIG. 1A.

Figure 4:
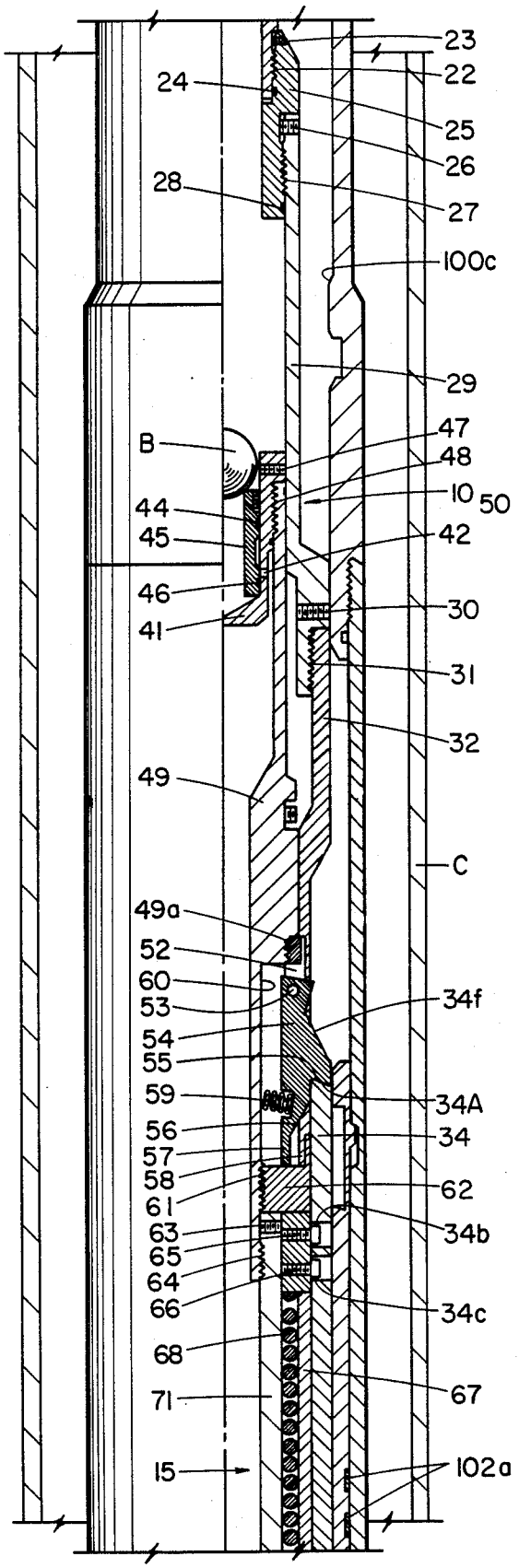
FIGS. 4 and 4A are sectional views showing continued manipulation of the apparatus to shift same such that the actuating means and shifting means have been moved to position for retrieval of the apparatus to the top of the well.
Figure 4A:
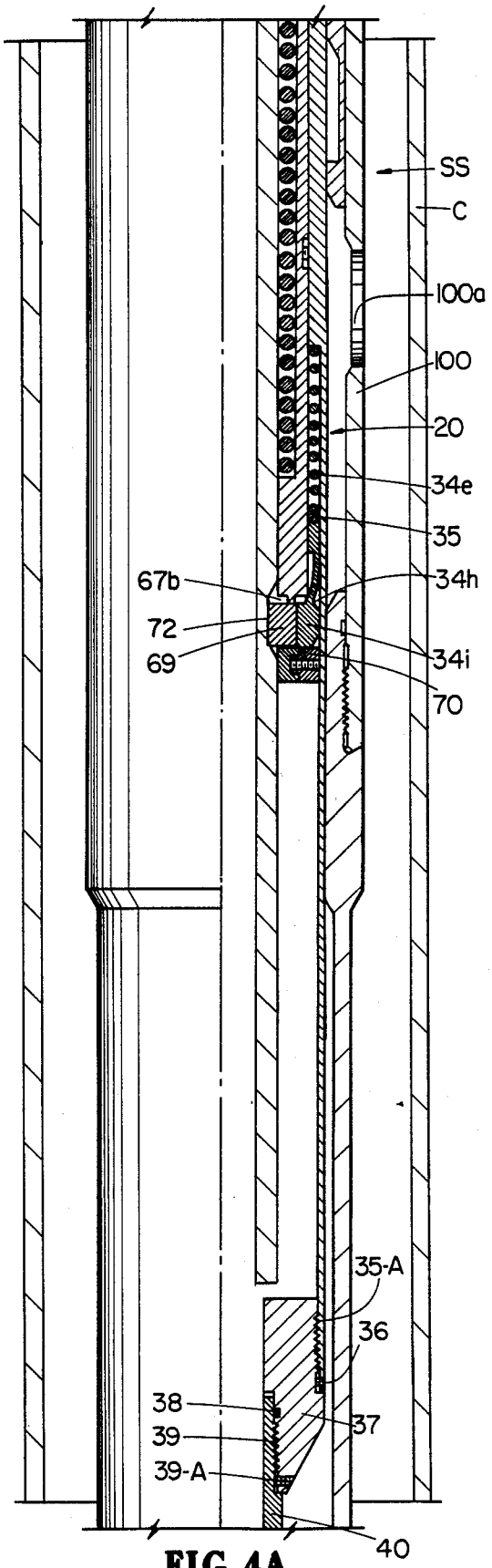
Figure 7:
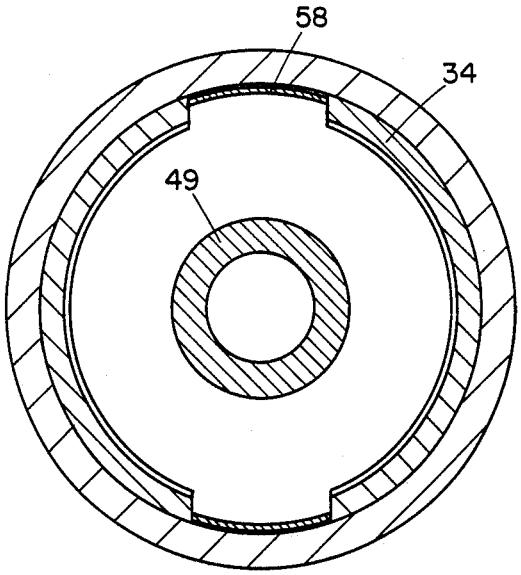
FIG. 7 is a cross-sectional view taken along line 7—7 of FIG. 1.
Figure 8:
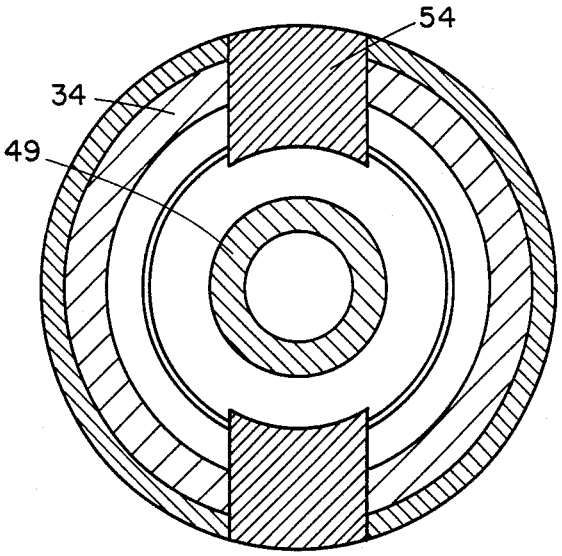
FIG. 8 is a cross-sectional view taken along lines 8—8 of FIG. 1.
Figure 9:
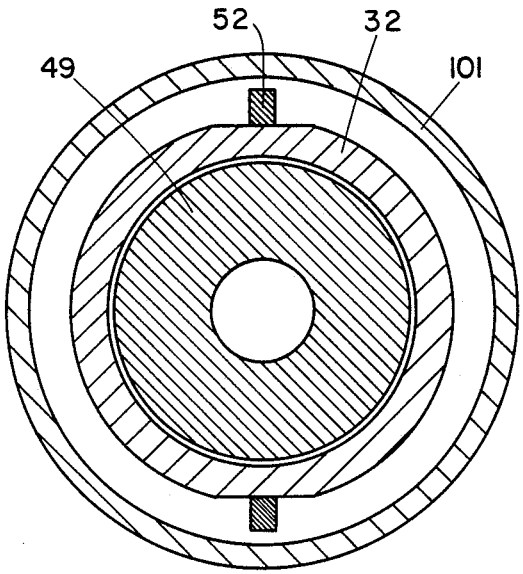
FIG. 9 is a cross-sectional view taken along lines 9—9 of FIG. 1.
Figure 10:
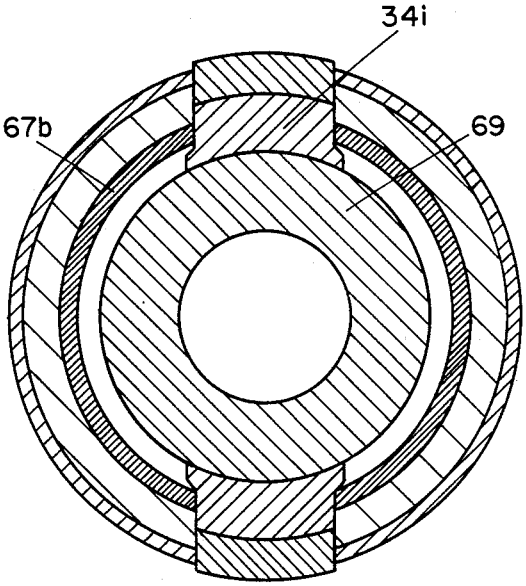
FIG. 10 is a cross-sectional view taken along lines 10—10 of FIG. 2A.

The spring mandrel 71 has an enlarged dog receiving groove 72 for receipt of the collet retaining dogs 69 when it is desired to release the apparatus 10 relative to the sliding sleeve SS auxiliary tool after manipulation of the sleeve member 101, as desired, to position the dogs 69 as shown in FIG. 4A to permit complete retraction of the keys 34*i* such that they may flex inwardly away from the exterior of the release mandrel 34.

The spring housing 32 also provides at its lowermost end a window 67*b* for receipt of the collet retaining dogs 69 which are flexibly normally urged inwardly for smooth carriage around the exterior surface of the spring mandrel 71, the dogs 69 being kept in lower implacement relative thereto by means of a lower release ring 70 carried exteriorly around the lowermost end of the spring housing 32.

Each of the sliding sleeves SS will have a shifting shoulder 100*d* companionly profiled to receive the shoulder 55 of the shifting dogs 54, such profile being in the form of the shifting profile 34*a* of the release mandrel 34.

Thus, as shown, the indicating means of the apparatus 10, for indicating passage of the apparatus 10 immediate sliding sleeves SS, which may, or may not, be desired to be manipulated, comprises the keys 34-*i* shoulder 34-*g*, spring housing 32, groove 73, lower spring member 34-*e*, key retainer 35, and window 34-*f*.

The actuating means of the apparatus 10 comprises the indicating means, as well as the upward profile shoulder 34-*h* of the keys 35-*i*, together with the collet retaining dogs 69, spring housing 32 and main spring 68.

The shifting means of the apparatus 10 includes the shifting dogs 54, the release mandrel 34, the spring 59, the main spring 68 and the inner mandrel system 15.

The hydraulic means includes the ball B, piston 45, cylinder 41, upper mandrel member 49, and associated components.

The releasing means comprises the spring housing 32, collet retaining dog 69 and dog receiving grooves 72 on the spring mandrel 71, generally speaking.

OPERATION

The apparatus 10 is run into the well, as shown in FIG. 1. As the apparatus 10 is moved on the coiled tubing CT the keys 34-*i* will protrude, slightly, out of the window 34-*f*. As the tool 10 is manipulated in the well W to the first, and subsequent sliding sleeve assemblies, SS, the keys 34-*i* will come into abutment contact with outwardly extending shoulder 100*c* of the housing 100 of the sliding sleeve assembly SS, thus moving the keys 34-*i* upwardly within the window 34-*f* and compress the lower spring member 34-*e*, until the keys 34-*i* come into axial alignment with the groove 73 of the spring housing 32. At such time, the keys 34-*i* will flex inwardly into receiving position within the groove 73 to permit the apparatus 10 to continue downward travel within the sliding sleeve assembly SS as the coiled tubing CT continues to be lowered within the well W.

At such time as the apparatus 10 approaches the sliding sleeve SS which is to be manipulated, the keys 34-*i* will again abut another shoulder 100*c* on the particular sliding sleeve SS to be manipulated. The resistance to downward movement of the coiled tubing CT caused by the interface of the keys 34*i* upon the shoulder 100*c* will be detected at the surface of the well by the operator. Now, since the operator knows the distance between the shoulder 100*c* and the actuating shoulder 100*e* on the housing 100 of the sliding sleeve SS, the coiled tubing CT will be lowered at corresponding distance until the keys 34*i* are just below and in proximity to the shoulder 100*e*. Now, continued upward pull on the coiled tubing CT will be resisted.

Figure 2:
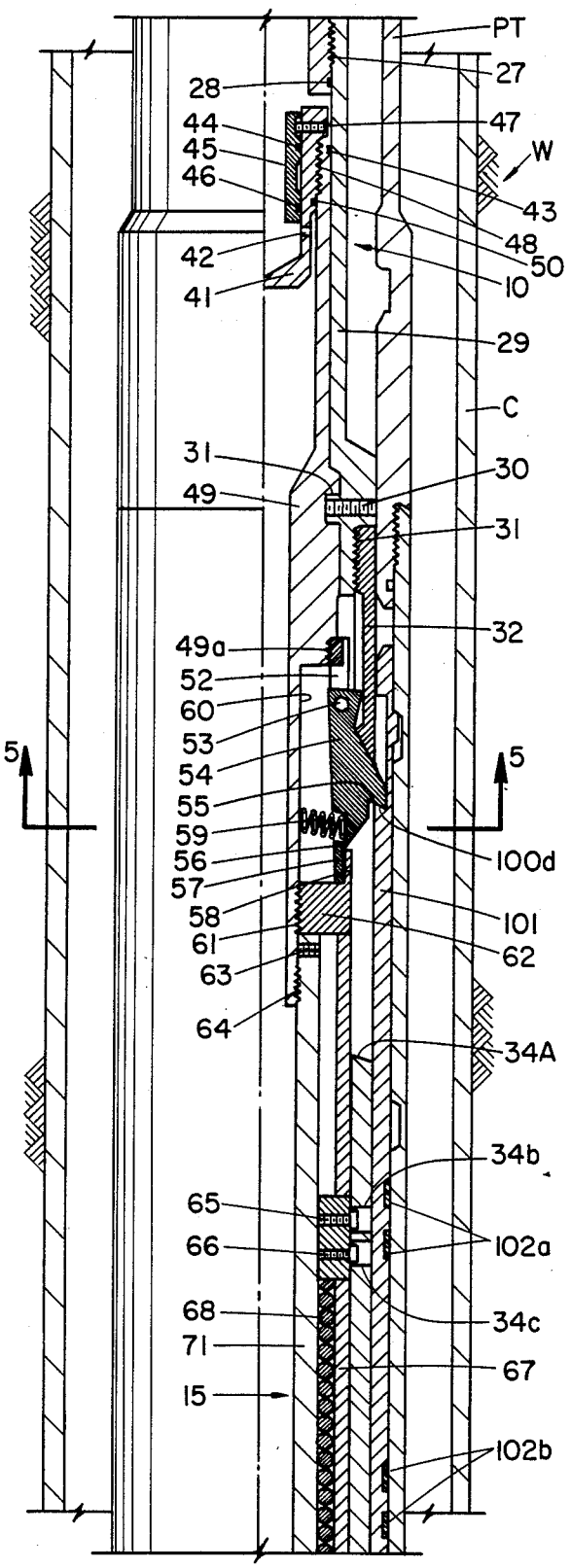
FIGS. 2 and 2A constitute a view similar to that of FIGS. 1 and 1A, showing the apparatus of the invention shifted to position whereby the actuating means have been moved to engaged position and the shifting means are in expanded position, each relative to the auxiliary tool.
Figure 2A:
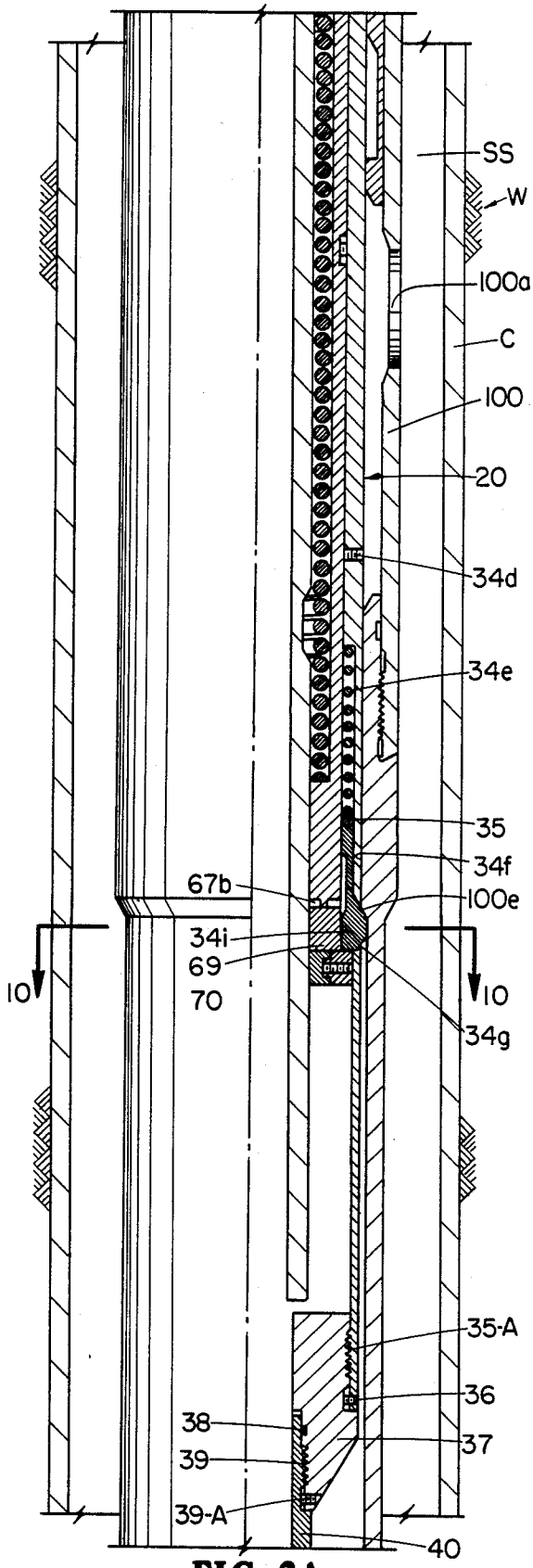

However, and as shown in FIGS. 2 and 2A, the coiled tubing CT is manipulated upwardly within the well W to "stretch" the apparatus 10 by upward movement of all of the components thereof, save the release mandrel 34 of the outer housing 20. As upward pull on the coiled tubing CT is effected, such pull is transmitted through the apparatus 10 by means of the connecting member 21, the connector 25, the central housing member 29, the spring housing member 32, the upper mandrel member 49, and the spring mandrel 71. As upward pull continues, the inner mandrel system 15 will move upwardly and the shifting profiles 34*a* on the release mandrel 34 will become disengaged from the companion shoulder 55 of the shifting dogs 54, thus permitting the force in the compressed spring 59 to drive the dogs 54 into the shifting profile 100*d* of the sleeve 101. The outer travel of the dogs 54 is limited by the interengagement of the tongue 57 on the dogs 54 with the companion inwardly facing abutment 58 on the retainer 62.

As the inner mandrel system 15 is moved upwardly, as described, the collet retaining dogs 69 are moved upwardly within the release mandrel 34 and the spring 68 is compressed. The collet retaining dog 69 are positioned interiorly and axially around the keys 34-*i*, as shown in FIG. 2A. The upward movement of the coiled tubing CT is transmitted to the dog 69 through the spring mandrel 71 and the lower release ring 70. As such upward movement occurs, the shear screw 34*d* will become sheared to permit the spring housing 32 to move upwardly relative to the stable mandrel 34, and compress the main spring 68. Now, the apparatus 10 is in extended position and is ready for actuation to the shifting mode to manipulate the sleeve 101 to close the port 100*a*.

Now, the ball B is placed within the interior of the coiled tubing CT at the top of the well and is permitted to gravitate or is pumped, if necessary, within the coiled tubing CT until it becomes sealingly engaged upon the seat 45*a* of the piston member 45. Pressure within the coiled tubing CT is increased until the shear screw 47 securing the piston 45 to the cylinder 41 is sheared and the piston 45 is permitted to shift downwardly within the cylinder 41, until such time as the seals 44, 46 bridge the port 42, thereby closing the port 42 and preventing fluid communication thereacross from the exterior of the cylinder 41 to its interior. Now, upper mandrel member 49, and its associated parts, have, in effect, been converted into a piston. Continued increase of pressure is exerted upon the uppermost end of the piston at seals 50, 43 and 44, 46 and shear pin 30 is broken. This downward movement of the inner mandrel system 15 relative to the outer housing 20 permits the shifting dogs 54 to transfer such downward movement to the sleeve 101 until it is manipulated to its lowermost position to close the port 100*a*.

It should be noted that the distance between the lower end of the collet retaining dogs 69 and the lowermost end of the dog receiving groove 72 will be equal to the length of travel from the initial up position of the sleeve 101 to its lowermost position within the housing 100 of the sliding sleeve assembly SS. Accordingly, as the apparatus 10 shifts the sleeve 101 downwardly, the inner mandrel system 15 will move down. The upper end of the release mandrel 34 now will come into contact with the conical profile 56 of the shifting dogs 54 to overcome the force of the spring 59 and drive the shifting dogs 54 back into the initial retracted position, and will also cause the interengagement of the shifting profile 34*a* into engagement with the companion profile 55 of the shifting dogs 54. The collet retaining dog 69 will be received by inward flexing movement thereof within the dog receiving groove 72, just as the sleeve 101 is placed in its lowermost position. Accordingly, the keys 34-*i* will be permitted to flex inwardly within the window 67-*b*, and since resistance to upper movement of the outer housing 20 is no longer provided by the interengagement of the keys 34-*i* to the shoulder 100*e* of the sliding sleeve assembly SS. Now, the apparatus 10 is released from the sliding sleeve assembly SS, and the coiled tubing CT may be withdrawn to retrieve the apparatus 10 to the top of the well W. This position is shown in FIGS. 4 and 4A.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for introduction into a subterranean well on a first conduit insertable through a second conduit previously positioned within said well, said second conduit carrying thereon at least one auxiliary tool, each of said auxiliary tools having means movable in at least one of first and second directions for manipulating the respective auxiliary tool, said apparatus comprising:

(1) a cylindrical tubular housing having a fluid passageway therethrough communicable with the interior of the first conduit for transmission of fluid from within the first conduit through said apparatus, and positionable in said well in proximity to one of said auxiliary tools;

(2) means for selectively indicating proximity of said apparatus relative to said one of said auxiliary tools when said first conduit is moved in a first direction;

(3) actuating means activatable by longitudinal manipulation of said first conduit and movable into engaging position with said auxiliary tool upon a first movement of said first conduit in a second direction, thereby resisting movement of said apparatus in said second direction;

(4) normally retracted, selectively expandable, shifting means movable into an expanded position by movement of said first conduit in said second direction to interengage said movable means of said auxiliary tool;

(5) hydraulic means activatable to drive said movable means in an actuating direction when said shifting means are in said expanded position; and (6) hydraulically responsive releasing means for moving said actuating means into disengaging position relative to said movable means and for moving said shifting means into the normally retracted position.

2. The apparatus of claim 1 wherein the means carried by said housing for selectively indicating proximity of said apparatus relative to said auxiliary tool comprises a plurality of outwardly flexible means movable in a radially expandable direction away from said housing and into contact with said auxiliary tool.

3. The apparatus of claim 2 wherein the outwardly flexible means comprises collet members.

4. The apparatus of claim 1 wherein the actuating means comprises first and second shoulders of said means carried by said housing for selectively indicating proximity of said apparatus relative to said auxiliary tool, one of said shoulders engaging said auxiliary tool and the other of said shoulders being engagable relative to said cylindrical tubular housing.

5. The apparatus of claim 1 wherein the shifting means comprises radially expandable means having profile means circumferentially subscribed exteriorly therearound for companion engagement relative to oppositely directed profile means on the movable means of the auxiliary tool.

6. The apparatus of claim 5 wherein the shifting means further comprises ramp means for urging and maintaining said shifting means into normally retracted position.

7. The apparatus of claim 1 wherein the hydraulic means comprises a shiftable piston element having an interiorly suspended selectively disengagable valve seat thereon.

8. The apparatus of claim 1 wherein the releasing means comprises normally expanded selectively contractable means for movement radially inwardly of said actuating means whereby movement of said apparatus in said second direction is no longer resisted, and means longitudinally movable relative to said expandable shifting means for interengagement with said shifting means to move said shifting means to normally retracted position, said means longitudinally movable comprising a sleeve biased toward said shifting means and movable in a biased direction toward said shifting means when said actuating means is in disengaged position.

9. An apparatus for introduction into a subterranean well on a continuous length of remedial tubing concentrically insertable through production tubing previously positioned within said well, said production tubing carrying thereon at least one ported member for selective transmission of fluids between the exterior and interior of the production tubing, each of said ported members receiving means movable in each of opening and closing directions for opening and closing the respective ported member, said apparatus comprising:

(1) a cylindrical tubular housing having a fluid passageway therethrough communicable with the interior of the remedial tubing for transmission of fluid from within the remedial tubing through the apparatus, and positionable in said well in proximity to one of said ported members;

(2) means carried by said housing for selectively indicating proximity of said apparatus relative to said ported member when said remedial tubing is moved in a first direction;

(3) actuating means activatable by longitudinal manipulation of said remedial tubing and movable into engaging position with said ported member upon a first movement of said remedial tubing in a second direction thereby resisting movement of said apparatus in said second direction;

(4) normally retracted, selectively expandable, shifting means carried by said housing and movable into an expanded position by movement of said remedial tubing in said second direction to interengage said movable means of said ported member;

(5) hydraulic means activatable to drive said movable means of said ported member in one of opening and closing directions when said shifting means is in said expanded position; and (6) hydraulically responsive releasing means for moving said actuating means into disengaging position and for moving said shifting means into the normally retracted position.

10. The apparatus of claim 9 wherein the means carried by said housing for selectively indicating proximity of said apparatus relative to said ported member comprises a plurality of outwardly flexible means movable in a radially expandable direction away from said housing and into contact with said ported member.

11. The apparatus of claim 9 wherein the outwardly flexible means comprises collet members.

12. The apparatus of claim 9 wherein the actuating means comprises first and second shoulders of said means carried by said housing for selectively indicating proximity of said apparatus relative to said ported member, one of said shoulders engaging said ported member and the other of said shoulders being engagable relative to said cylindrical tubular housing.

13. The apparatus of claim 9 wherein the shifting means comprises radially expandable means having profile means circumferentially subscribed exteriorly therearound for companion engagement relative to oppositely directed profile means on the movable means of the ported member.

14. The apparatus of claim 9 wherein the hydraulic means comprises a shiftable piston element having an interiorly suspended selectively disengagable valve seat thereon.

15. The apparatus of claim 9 wherein the releasing means comprises normally expanded selectively radially contractable means for movement radially inwardly of said actuating means whereby movement of said apparatus in said second direction is no longer resisted, and means longitudinally movable relative to said expandable shifting means for interengagement engagement with said shifting means and to move the shifting means to normally retracted position, said means longitudinally moveable comprising a sleeve biased toward said shifting means and movable in a biased direction toward said shifting means when said actuating means is in disengaged position.

16. A method for selectively shifting a tool member carried within a subterranean well, comprising the steps of:

(1) assembling at the well surface on a first conduit, an apparatus for introduction into said well on said first conduit and concentrically insertable through a second conduit previously positioned within said well, said second conduit carrying thereon at least one auxiliary tool, each of said auxiliary tools receiving a tool member movable in at least one direction for activating said auxiliary tool, said apparatus comprising:

(a) a cylindrical tubular housing having a fluid passageway therethrough communicable with the interior of the first conduit for transmission of fluid from within the first conduit through said apparatus, and positionable in said well in proximity to one of said auxiliary tools;

(b) means for selectively indicating proximity of said apparatus relative to said one of said auxiliary tools when said first conduit is moved in a first direction;

(c) actuating means activatable by longitudinal manipulation of said first conduit and movable into engaging position with said auxiliary tool upon a first movement of said first conduit in a second direction, thereby resisting movement of said apparatus in said second direction;

(d) normally retracted, selectively expandable, shifting means movable into an expanded position by movement of said first conduit in said second direction to move the shifting means into expanded position to interengage said tool member of said auxiliary tool;

(e) hydraulic means activatable to drive said tool member in an actuating direction when said shifting means is in said expanded position; and (f) hydraulically responsive releasing means for moving said actuating means into disengaging position and for moving said shifting means into the normally retracted position;

(2) manipulating said conduit in a first direction to move said apparatus for actuation of the means to selectively indicate proximity of said apparatus relative to said auxiliary tool;

(3) longitudinally manipulating said first conduit in a second direction to move said actuating means into engaging position with said auxiliary tool to thereby resist movement of said apparatus in said second direction;

(4) manipulating said first conduit in said second direction to move the shifting means into expanded position to interengage the tool member of said auxiliary tool;

(5) applying pressure through said hydraulic means to thereby drive said tool member of said auxiliary tool in said actuating direction when the shifting means are in the expanded position; and (6) manipulating said first conduit to cause said releasing means to move said actuating means into disengaging position and for moving the shifting means into the normally retracted position.

17. A method for selectively shifting a tool member carried within a subterranean well, comprising the steps of:

(1) assembling at the well surface on a continuous length of remedial tubing, an apparatus for introduction into said well on said continuous length of remedial tubing concentrically insertable through production tubing previously positioned within said well, said production tubing carrying thereon at least one ported member, each of said ported members receiving means movable in at least one direction for opening or closing said ported member, said apparatus comprising:

(a) cylindrical tubular housing having a fluid passageway therethrough communicable with the interior of the continuous length of remedial tubing for transmission of fluid from within the continuous length of remedial tubing through said apparatus, and positionable in said well in proximity to one of said ported members;

(b) means carried by said housing for selectively indicating proximity of said apparatus relative to said one of said ported members when said continuous length of remedial tubing is moved in a first direction;

(c) actuating means activatable by longitudinal manipulation of said continuous length of remedial tubing and movable into engaging position with said ported member upon a first movement of said continuous length of remedial tubing in a second direction, thereby resisting movement of said apparatus in said second direction;

(d) normally retracted, selectively expandable, shifting means carried by said housing and movable into an expanded position by movement of said continuous length of remedial tubing in said second direction to move the shifting means into expanded position to interengage said movable means of said ported member;

(e) hydraulic means activatable to drive said movable means in an actuating direction when said shifting means is in said expanded position; and (f) hydraulically responsive releasing means for moving said actuating means into disengaging position and for moving said shifting means into the normally retracted position;

(2) manipulating said conduit to move said apparatus for actuation of the means carried by the housing to selectively indicate proximity of said apparatus relative to said ported member;

(3) longitudinally manipulating said continuous length of remedial tubing in a second direction to move said actuating means into engaging position with said ported member to thereby resist movement of said apparatus in said second direction;

(4) manipulating said continuous length of remedial tubing in said second direction to move the shifting means into expanded position to interengage the movable mean of said ported member;

(5) applying pressure through said hydraulic means to thereby drive said movable means of said ported member in said actuating direction when the shifting means are in the expanded position; and (6) manipulating said continuous length of remedial tubing to cause said releasing means to move said actuating means into disengaging position and for moving the shifting means into the normally retracted position.

* * * * *